US006644329B2

(12) United States Patent
Tomason

(10) Patent No.: US 6,644,329 B2
(45) Date of Patent: Nov. 11, 2003

(54) TENT ADAPTED FOR ATTACHMENT TO A COT

(76) Inventor: Wallace G Tomason, P.O. Box 373, Ponderay, ID (US) 83852

( * ) Notice: Subject to any disclaimer, the term of this patent is extended or adjusted under 35 U.S.C. 154(b) by 0 days.

(21) Appl. No.: 09/921,094

(22) Filed: Aug. 3, 2001

(65) Prior Publication Data

US 2003/0024560 A1 Feb. 6, 2003

(51) Int. Cl.[7] ..... E04H 15/02
(52) U.S. Cl. ..... 135/96; 135/90
(58) Field of Search ..... 135/115, 117, 135/90, 96, 124; 5/111, 113, 121, 414

(56) References Cited

U.S. PATENT DOCUMENTS 1,751,290 A * 3/1930 Race ..... 135/136
3,601,825 A * 8/1971 Moorhead et al. ..... 5/110
3,933,164 A * 1/1976 Ness et al. ..... 135/95
4,914,768 A * 4/1990 Howard ..... 5/113
4,939,803 A * 7/1990 Waters ..... 5/414
4,945,584 A * 8/1990 LaMantia ..... 5/97
5,072,694 A * 12/1991 Haynes et al. ..... 119/482
D372,953 S * 8/1996 Florez ..... D21/838
5,988,195 A * 11/1999 Kaestner et al. ..... 135/144
6,098,218 A * 8/2000 Ventura ..... 5/113
6,192,909 B1 * 2/2001 Strausser ..... 135/137
6,260,566 B1 * 7/2001 LaFave et al. ..... 135/88.01

* cited by examiner

*Primary Examiner*—Janet M. Wilkens

(57) ABSTRACT

A tent is adapted for attachment to a cot. A preferred version of a tent includes a body made of fabric or similar sheet material, with a floor, two ends and two sides. A frame includes first and second frame poles carried within sleeves defined within the fabric body. Four to six fasteners secure the body to the frame of the cot. Each fastener passes around the frame, through a hole defined between the cot frame and cot fabric, and is secured to the bottom of the floor. A rain guard includes two opposed side panels and two opposed end panels. The rain guard prevents rain from pooling on the tent floor or on the horizontal fabric of the cot. Rain moving down the fabric body is guided past the tent floor and cot fabric, where it is released.

2 Claims, 3 Drawing Sheets

TENT ADAPTED FOR ATTACHMENT TO A COT

CROSS-REFERENCES

There are no applications related to this application filed in this or any foreign country.

BACKGROUND

Small tents have undergone considerable change in recent years. Small tents previously included only "pup tents," which tended to be heavy to carry and uncomfortable to use. As a result, lighter weight back packing tents have essentially replaced this type of tent. Backpacking tents offer light weight construction, easier set-up and take-down, and tend to provide better service overall.

Unfortunately, while improvements in weight, strength and durability have been made, small tents still tend to be uncomfortable in use. In large part, this is because they are still dependent upon air mattresses and similar devices to support sleeping people. As a result, larger tents, which allow use of cots, are generally perceived as being more comfortable. Unfortunately, tents of a larger size are typically very heavy, and because the tent is typically made in one piece, the weight may not be shared by a number of people.

For the foregoing reasons, there is a need for a smaller tent that includes the advantages of smaller tents, but that also allows the use of cots to provide sleeping comfort in a manner similar to large tents.

SUMMARY

The present invention is directed to an apparatus that satisfies the above needs. A novel tent adapted for attachment to a cot is disclosed that combines the advantages of a small tent with the advantages of large tents, which allow the use of cots.

A tent 10 is adapted for attachment to a cot 100, particularly a cot of the type having a frame with at least four legs and a generally horizontal fabric panel for the support of a resting individual, wherein four to six holes are defined between the frame and a perimeter of the fabric panel. A preferred version of a tent includes some or all of the components below.

(A) A body 20 is typically made of fabric or similar sheet material, and includes a floor 30, two ends 40, 42 and two sides 50, 52.

(B) A frame 60 includes first and second frame poles 62, 64carried within sleeves defined within the fabric body.

(C) Four to six fasteners 80 secure the body 20 to the frame of the cot. Each fastener passes around the frame, through a hole defined between the cot frame and cot fabric, and is secured to the bottom of the floor 30. VELCRO(tm) or similar fastening material may be used to secure the fasteners.

(D) A rain guard 90 includes two opposed side panels and two opposed end panels. The rain guard prevents rain from pooling on the tent floor 30 or on the horizontal fabric of the cot. Rain moving down the fabric body is guided past the tent floor and cot fabric, where it is released.

It is therefore a primary advantage of the present invention to provide a novel tent adapted for attachment to a cot wherein a rain guard prevents rain water from accumulating on the floor of the tent or on the surface of the cot.

Another advantage of the present invention is to provide a novel tent adapted for attachment to a cot wherein the tent assembles and disassembles, and attaches and detaches to the cot, without difficulty.

A still further advantage of the present invention is to provide a novel tent adapted for attachment to a cot that combines the light weight and portability of a small tent with the comfort and adaptability for use with a cot found in a large tent.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 1:
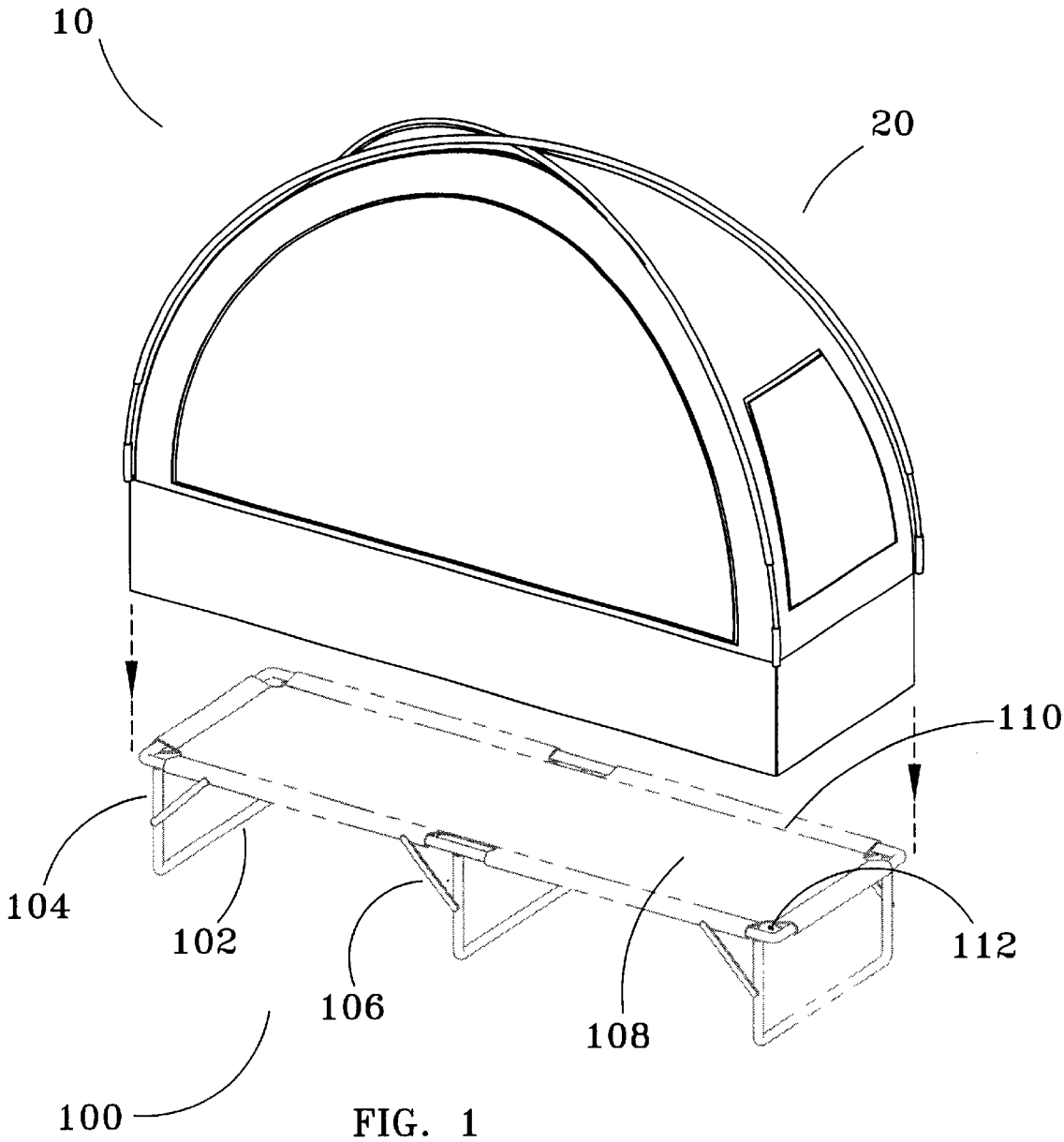
FIG. 1 is an exploded perspective view of a version of the tent adapted for attachment to a cot, showing how the tent and cot are related in use.
Figure 2:
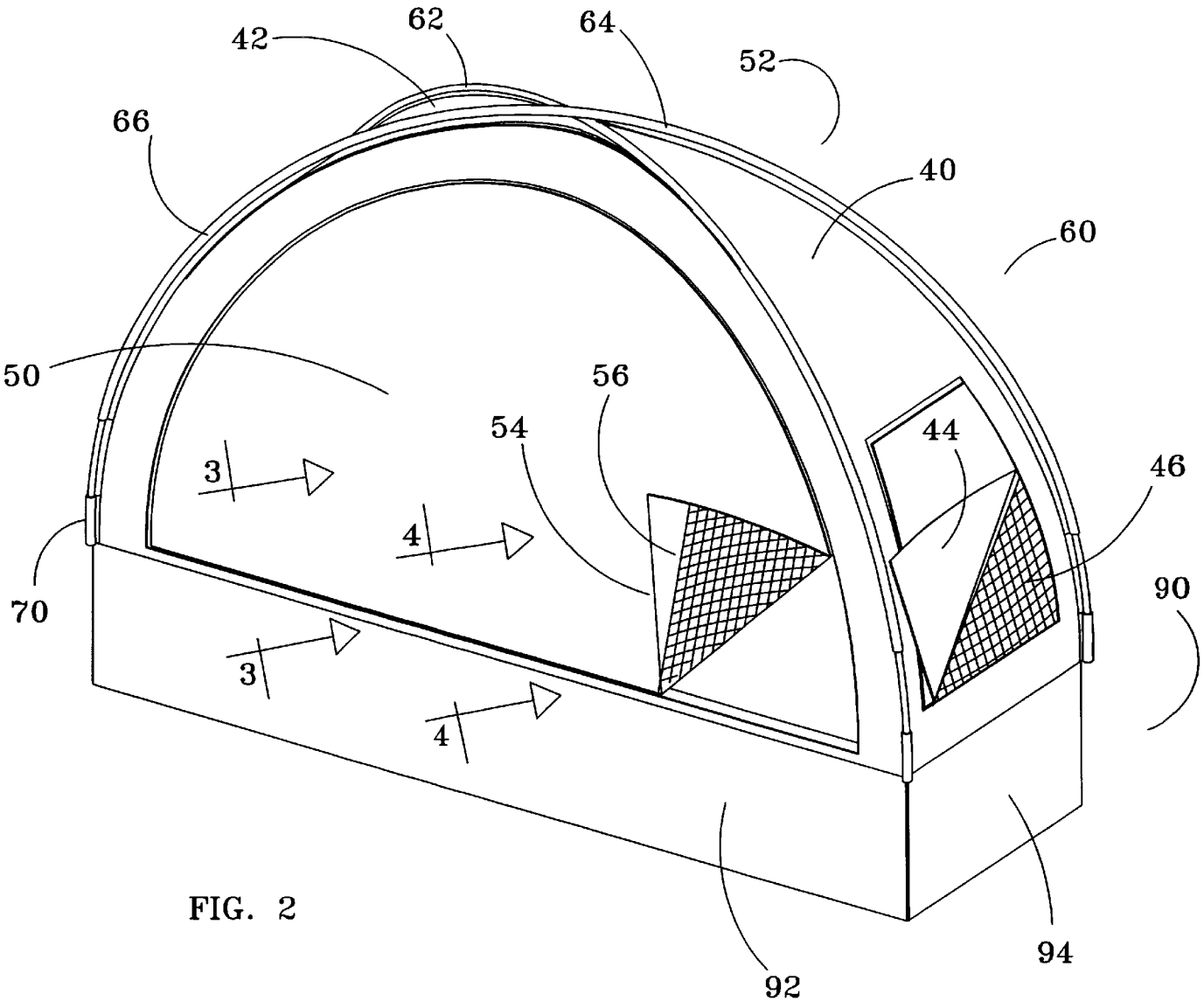
FIG. 2 is an enlarged perspective view similar to that of FIG. 1, showing details of a door and window.
Figure 3:
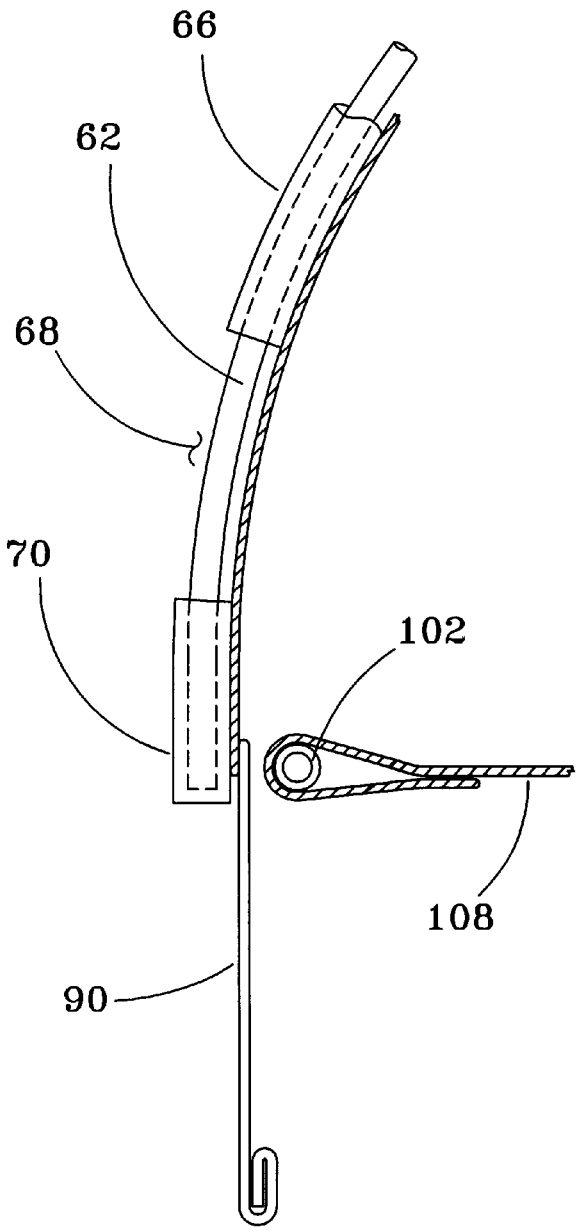
FIG. 3 is a cross sectional view according to the 3—3 lines of FIG. 2, showing the wall and rain guard of the tent and the fabric and frame of the cot.

OVERVIEW. Referring in generally to FIGS. 1 and 2, a tent 10 is adapted for attachment to a cot 100, particularly a cot of the type having a frame 102 with at least four legs 104, in some cases supported by a brace 106. A generally horizontal fabric panel 108 is sewn 110 to the frame, and supports a resting individual, wherein the fabric panel defines four to six holes or openings 112 between the frame and a perimeter of the fabric panel. A preferred version of a tent includes a body 20 made of fabric or similar sheet material, with a floor 30, two ends 40, 42 and two sides 50, 52. A frame 60 includes first and second frame poles carried within sleeves defined within the fabric body. Four to six fasteners 80 secure the body 20 to the frame of the cot. Each fastener passes around the frame, through a hole defined between the cot frame and cot fabric, and is secured to the bottom surface of the floor 30. A rain guard 90 includes two opposed side panels and two opposed end panels. The rain guard prevents rain from pooling on the tent floor 30 or on the horizontal fabric of the cot. Rain moving down the fabric body is guided past the tent floor and cot fabric, where it is released.

TENT BODY. A body 20 is typically made of fabric or similar sheet material, and includes a floor 30, two ends 40, 42 and two sides 50, 52. One of the sides 50 typically includes a door flap 54 and associated screen door 56. By placing the door flap on the side, the user is able to enter the tent without collapsing the cot. The opposite side 52 may include a window and screen, if desired.

One or both ends 40, 42 typically include a window flap 44 and screen 46. The screen is typically sewn closed, while the window flap may be opened as needed.

FRAME. A tent frame 60 includes first and second frame poles 62, 64 carried within sleeves 66 defined within the fabric body 20. A sleeve opening 68 allows a pole to be inserted into the sleeve, while a sleeve socket 70 secures the end of the pole.

FASTENERS. Four to six fasteners 80 secure the body 20 to the frame of the cot. Each fastener passes around the frame, through a hole 112 defined between the cot frame and cot fabric, and is secured to the bottom of the floor 30. VELCRO(tm) or similar fastening material may be used to secure the fasteners. Generally, the number of fasteners 80 is equal to the number of openings 112 defined in the cot to be used.

Figure 4:
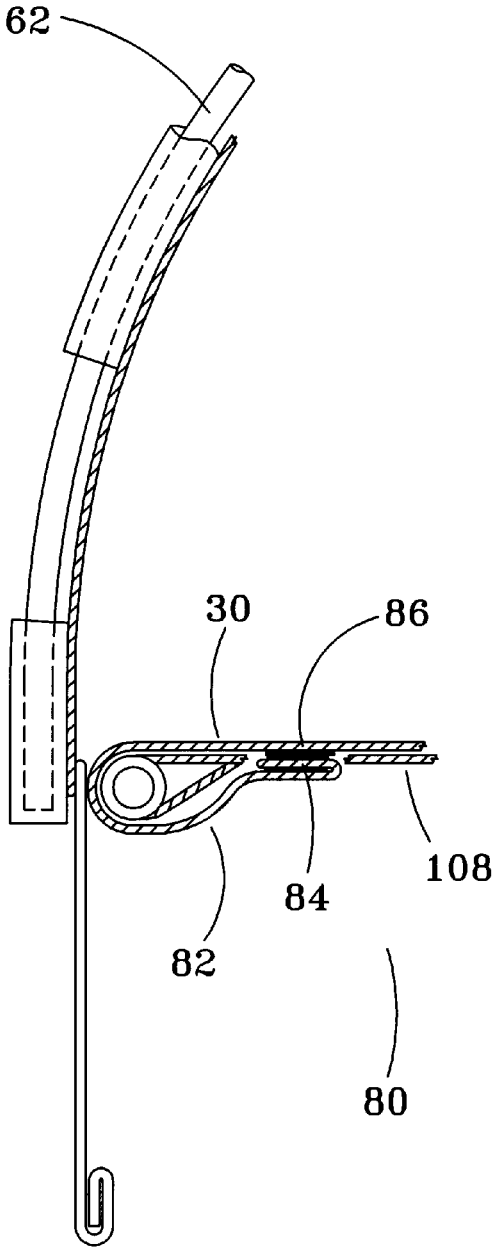
FIG. 4 is a cross section view according to the 4—4 lines of FIG. 2, showing the manner in which the fasteners attach to an opening defined between the frame and fabric bed of the cot.

Referring particularly to FIG. 4, it can be seen that the fastener 80 includes a strap 82. The strap is passed through the hole or opening 112 in the cot 100. A first VELCRO(tm) or similar fastener 84 is carried on the end of the strap. A second VELCRO(tm) or similar fastener 86 is carried on the bottom of the tent floor 30. By passing the strap 82 through the opening 112, and securing the fasteners 84, 86, the tent 10 is securely connected to the cot.

RAIN GUARD. A rain guard 90 includes two opposed side panels 92 and two opposed end panels 94. The rain guard may be a continuous extension of the tent sides and ends, or may be formed of separate panels secured to the perimeter of the floor of the tent. In use, the rain guard prevents rain from pooling on the tent floor 30 or on the horizontal fabric of the cot. Rain moving down the fabric body is guided past the tent floor and cot fabric, where it is released.

ADVANTAGES. The previously described versions of the present invention have many advantages, including a primary advantage of providing a novel tent adapted for attachment to a cot wherein a rain guard prevents rain water from accumulating on the floor of the tent or on the surface of the cot.

Another advantage of the present invention is to provide a novel tent adapted for attachment to a cot wherein the tent assembles and disassembles, and attaches and detaches to the cot, without difficulty.

A still further advantage of the present invention is to provide a novel tent adapted for attachment to a cot that combines the light weight and portability of a small tent with the comfort and adaptability for use with a cot found in a large tent.

Although the present invention has been described in considerable detail and with reference to certain preferred versions, other versions are possible. For example, while a tent adapted for use with a cot having three pair of openings associated with three double or six individual legs was disclosed, a similar tent, adapted for use with cots of differing number of legs could alternatively be constructed. Therefore, the spirit and scope of the appended claims should not be limited to the description of the preferred versions disclosed.

In compliance with the U.S. patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A tent adapted for attachment to a cot, the tent comprising:

(A) a tent body, comprising a floor connected to two end panels and two side panels;

(B) a tent frame, comprising first and second frame poles carried within sleeves defined within the tent body;

(C) at least four fasteners to secure the tent body to a frame of the cot, each fastener comprising a strap extending from the floor carrying a first fastening material connectable to a second fastening material carried on a lower surface of the floor; and (D) a rain guard, comprising two opposed side panels and two opposed end panels, attached to a perimeter of the floor.

2. A tent and associated cot, comprising:

(A) a cot having a frame;

(B) a tent body, comprising a floor connected to two end panels and two side panels;

(C) a tent frame, comprising first and second frame poles carried within sleeves defined within the tent body;

(D) at least four fasteners to secure the tent body to the frame of the cot, each fastener comprising a strap extending from the floor carrying a first fastening material connectable to a second fastening material carried on a lower surface of the floor; and (E) a rain guard, comprising two opposed side panels and two opposed end panels, attached to a perimeter of the floor.

* * * * *